US006641216B2

(12) United States Patent
Rogers, III et al.

(10) Patent No.: US 6,641,216 B2
(45) Date of Patent: Nov. 4, 2003

(54) METHODS AND APPARATUS FOR MECHANICALLY CONTROLLING ADJUSTMENT OF A CHAIR

(75) Inventors: M. Weldon Rogers, III, St. Louis, MO (US); Robert A. Eberle, Kansas City, MO (US); Joseph M. Mooney, Florissant, MO (US); David L. Schwartz, Creve Coeur, MO (US)

(73) Assignee: EAC Corporation, St. Louis, MO (US)

( * ) Notice: Subject to any disclaimer, the term of this patent is extended or adjusted under 35 U.S.C. 154(b) by 16 days.

(21) Appl. No.: 09/878,451

(22) Filed: Jun. 11, 2001

(65) Prior Publication Data

US 2002/0185901 A1 Dec. 12, 2002

Related U.S. Application Data

(60) Provisional application No. 60/257,066, filed on Dec. 20, 2000, and provisional application No. 60/263,407, filed on Jan. 23, 2001.

(51) Int. Cl.[7] ..... A47C 3/40

(52) U.S. Cl. ..... 297/344.2; 297/330; 297/337; 297/362.11; 297/344.18

(58) Field of Search ..... 297/344.2, 344.18, 297/330, 337, 339, 362.11, 313

(56) References Cited

U.S. PATENT DOCUMENTS 2,920,684 A * 1/1960 Fante et al. ..... 297/330
2,930,428 A * 3/1960 Rose ..... 248/394
4,299,316 A * 11/1981 Reinmoeller ..... 192/48.8
4,432,583 A * 2/1984 Russo et al. ..... 297/330
4,944,555 A * 7/1990 Brusasco ..... 297/330
5,112,018 A * 5/1992 Wahls ..... 248/394
5,393,123 A * 2/1995 Hernandez et al. .... 297/378.12
5,556,163 A * 9/1996 Rogers et al. ..... 297/330
5,738,327 A * 4/1998 Tanaka et al. ..... 248/419
6,000,757 A * 12/1999 Sovis ..... 297/344.1
6,027,169 A * 2/2000 Roslund, Jr. ..... 297/337
6,033,021 A * 3/2000 Udo et al. ..... 297/313
6,203,107 B1 * 3/2001 Jonsson ..... 297/337

* cited by examiner

*Primary Examiner*—Peter R. Brown
*Assistant Examiner*—Joseph Edell
(74) *Attorney, Agent, or Firm*—Armstrong Teasdale LLP

(57) ABSTRACT

A mounting assembly for a chair that enables a plurality of mechanical adjustments to be made to the chair by a seated occupant in a cost effective and reliable manner is described. The mounting assembly is coupled to a control mechanism which includes a plurality of motor-gear groups and at least one control switch. The control switch is coupled to each motor-gear group, a rechargeable battery, and to a limit switch that limits an amount of electrical height adjustment of the chair seat with respect to the chair base. Each motor-gear group is coupled to a drive shaft and are used to electrically adjust the chair. As a result, a seated occupant may selectively engage mechanically adjust the chair seat relative independently of electrical adjustments available by the control mechanism.

45 Claims, 8 Drawing Sheets

METHODS AND APPARATUS FOR MECHANICALLY CONTROLLING ADJUSTMENT OF A CHAIR

CROSS REFERENCE TO RELATED APPLICATIONS

This application claims the benefit of U.S. Provisional Application No. 60/257,066 filed Dec. 20, 2000, and U.S. Provisional Application No. 60/263,407 filed Jan. 23, 2001.

BACKGROUND OF THE INVENTION

This application relates generally to adjustable chairs, and more particularly to height adjustment mechanisms used with adjustable chairs.

Office chairs typically include a chair back, a chair seat, and a base that supports the chair. The chair back is coupled to the chair seat, and the chair seat is coupled to the chair base. More specifically, a column extends between the base and the chair seat to support the chair seat. At least some known chair bases include casters or glides that enable the chair base to be in freely-rollable or freely-glidable contact with a floor.

Sitting in a chair that is improperly adjusted for prolonged periods of time may increase the discomfort and fatigue to the occupant. To facilitate improving a comfort level of seated occupants, at least some chairs include chair backs including adjustment mechanisms that permit the chair back to be variably positioned with respect to the chair seat, and permit the chair seat to be variably positioned with respect to the chair base. However, often the adjustments can not be made while the occupant is seated, and as a result, an adjustment process can be time-consuming and tedious as the occupant must often make numerous trial adjustments finding a chair seat position that is comfortable to the occupant.

SUMMARY OF THE INVENTION

In an exemplary embodiment, a mounting assembly for a chair enables a plurality of mechanical adjustments to be made to the chair by a seated occupant in a cost effective and reliable manner. The mounting assembly is coupled to a control mechanism which includes a plurality of motor-gear groups and at least one control switch. The control switch is coupled to each motor-gear group, a rechargeable battery, and to a limit switch that limits an amount of electrical height adjustment of the chair seat with respect to the chair base. Each motor-gear group is coupled to a drive shaft and are used to electrically adjust the chair.

During use, a seated occupant may selectively engage the mounting assembly to mechanically adjust the chair seat relative to the mounting bracket. More specifically, when engaged, the mounting bracket permits mechanical adjustments of the chair seat to be made that are independent of electrical adjustments that may be made using the control mechanism. As a result, the mounting assembly permits independent mechanical adjustments to be made in a cost-effective and reliable manner.

DETAILED DESCRIPTION OF THE INVENTION

Figure 1:
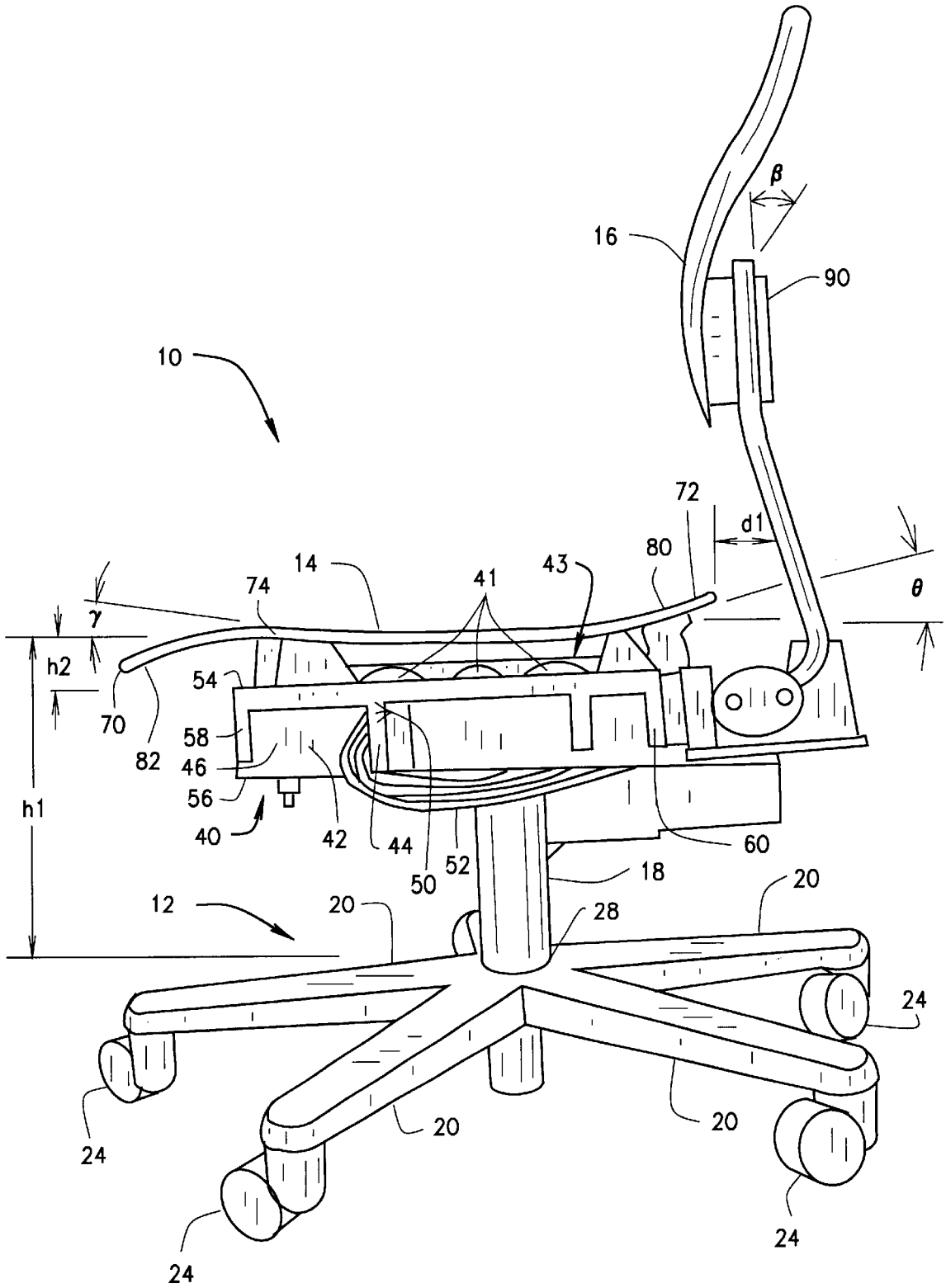
FIG. 1 is side view of an adjustable chair including a control mechanism.

FIG. 1 is a side view of an adjustable chair 10. In one embodiment, chair 10 is an office chair. Chair 10 includes a base 12, a seat 14, a back assembly 16, and a height adjustment mechanism 18. Chair back assembly 16 is coupled to chair seat 14, and chair base 12 supports chair 10.

Chair base 12 is known in the art and is a pedestal support base that includes a plurality of legs 20 arranged in a conventional star-shaped arrangement. In one embodiment, base 12 includes five legs 20. Alternatively, base 12 includes more or less than five legs. Each leg 20 includes a caster 24, such that chair 10 is in free-rolling contact with a floor (not shown). In an alternative embodiment, chair legs 20 do not include casters 24.

Base legs 20 support chair 10 and extend from casters 24 to a center socket 28. Socket 28 includes an opening (not shown in FIG. 1) extending therethrough and sized to receive height adjustment mechanism 18. Height adjustment mechanism 18 extends through base center socket 28, and is substantially perpendicular to base 12. More specifically, height adjustment mechanism 18 extends between base 12 and chair 10 and includes a drive mechanism (not shown in FIG. 1) for adjusting a height $h_1$ of chair seat 14 relative to chair base 12.

A control mechanism 40 is coupled to chair 10 and includes a plurality of motor-gear groups 41 that are selectively activated to independently adjust chair 10. More specifically, control mechanism 40 includes a housing 42 that defines a cavity 43, and motor-gear groups 41 are housed within housing cavity 43. A control panel 44 is attached to an exterior surface 46 of control mechanism housing 42 and includes at least one switch 50. Control panel 44 is electrically coupled to control mechanism 40 with a plurality of wiring 52 such that control panel switch 50 is selectively operable to activate motor-gear groups 41. Accordingly, control panel 44 is attached to control mechanism housing 42 such that control panel 44 is easily accessible by a seated occupant. In one embodiment, control panel switch 50 is biased to a neutral position.

Control mechanism 40 includes a receptacle (not shown) for receiving height adjustment mechanism 18. More specifically, control mechanism housing 42 has an upper side 54 and a lower side 56. The height adjustment receptacle is located within control mechanism housing lower side 56, and chair seat 14 is coupled to housing upper side 54. Housing 42 also includes a front side 58 and a rear side 60. Rear side 60 is between front side 58 and chair back assembly 16.

Chair seat 14 is coupled to control housing upper side 54 and includes a front edge 70 and a rear edge 72 connected with a pair of side edges 74. More specifically, chair seat 14 is co-axially aligned with respect to control housing 42 between chair seat side edges 74. Furthermore, chair seat 14 is coupled to control housing 42 such that chair rear edge 72 is between chair front edge 70 and chair back assembly 16.

Chair seat 14 includes a top surface 80 and a bottom surface 82. Chair seat 14 is coupled to control housing 42 such that chair bottom surface 82 is between chair top surface 80 and control housing 42. In the exemplary embodiment, chair seat 14 is contoured to facilitate comfort to a seated occupant, and chair seat top and bottom surfaces 80 and 82 are substantially parallel.

In the exemplary embodiment, control mechanism 40 permits chair 10 to be adjusted with a plurality of adjustments. Specifically, adjustments may be made to an angle $\theta$ of tilt of chair seat 14, with respect to control mechanism housing 42 and base 12, an angle $\gamma$ of tilt of chair seat 14 with respect to control mechanism housing 42, an angle $\beta$ of tilt of a chair back support 90 included within chair back assembly 16, with respect to chair seat 14, a depth $d_1$ of chair seat 14 with respect to chair back support 90, height $h_1$ of chair seat 14 with respect to base 12, and a height $h_2$ of chair seat 14 relative to control mechanism housing 42. More specifically, control mechanism 40 permits chair seat 14 to be angularly oriented at angles $\theta$, laterally displaced at depths $d_1$, and raised or lowered to heights $h_2$. Furthermore, control mechanism 40 permits chair back support 90 to be angularly oriented at angles $\beta$. In the exemplary embodiment shown in FIG. 1, control mechanism 40 includes four motor-gear groups 41 for adjusting seat angle $\theta$, chair back support angle $\beta$, seat depth $d_1$, seat angle $\gamma$, and chair height $h_2$.

Chair back assembly 16 is mechanically coupled to chair back support 90. In the exemplary embodiment, chair back assembly 16 is angularly adjustable independently of adjustments to chair back support 90 with respect to chair back support 90.

Figure 2:
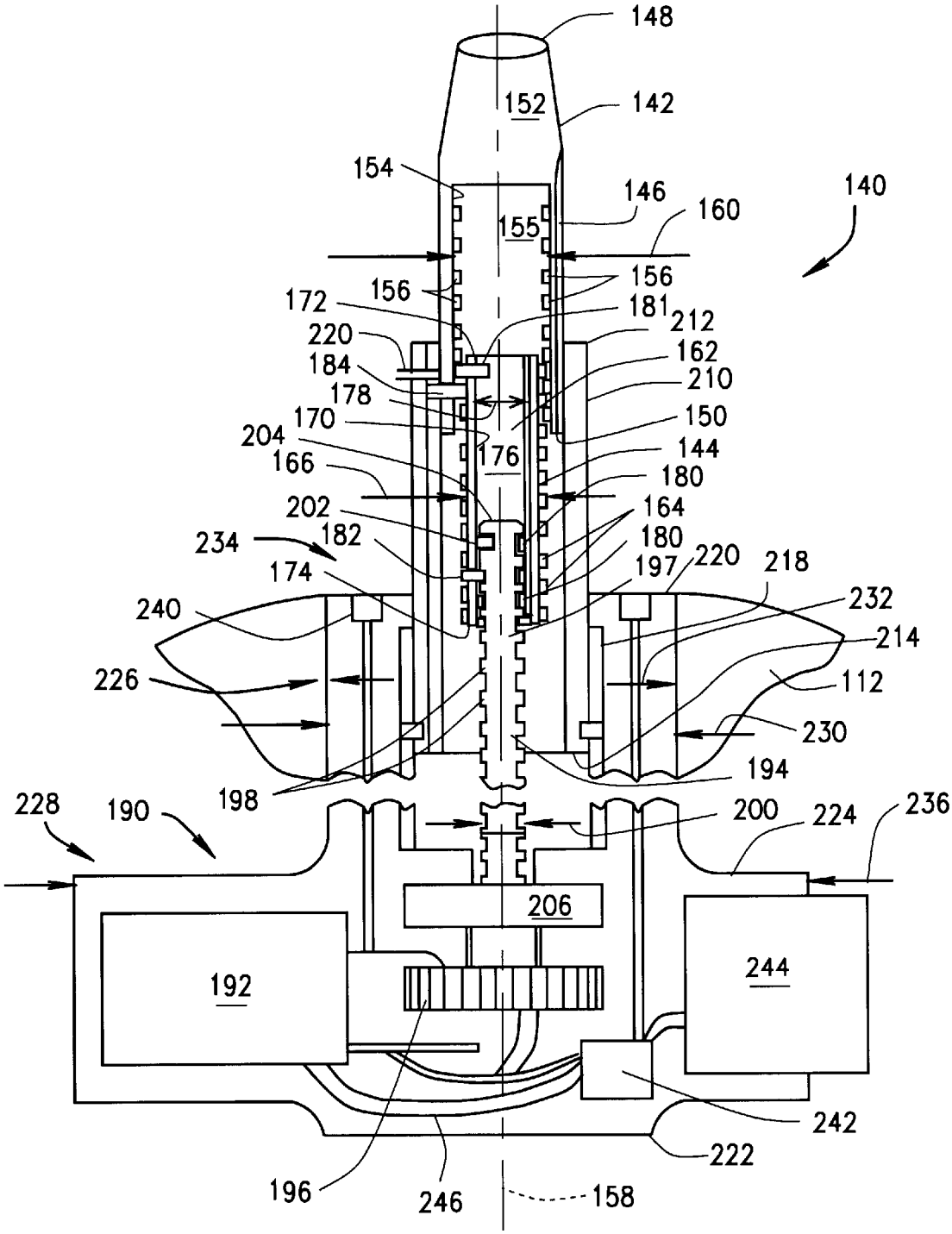
FIG. 2 is a partial cross-sectional side view of a height adjustment mechanism that may be used with the chair shown in FIG. 1.

FIG. 2 is a partial cross-sectional side view of a height adjustment mechanism 140 that may be used with chair 10 shown in FIG. 1. Height adjustment mechanism 140 includes an upper enclosure member 142 telescopically coupled to a lower enclosure member 144. More specifically, lower enclosure member 144 is coupled substantially co-axially to upper enclosure member 142 such that lower enclosure member 144 telescopes into upper enclosure member 142. Upper enclosure member 142 is coupled between chair seat 14 (shown in FIG. 1) and lower enclosure member 144. Lower enclosure member 144 is coupled between upper enclosure member 142 and chair base 12 (shown in FIG. 1). In one embodiment, upper enclosure member 142 has a substantially circular cross-sectional profile.

Upper enclosure member 142 includes a hollow guide sleeve 146, an upper end 148, and a lower end 150. In addition, upper enclosure member 142 includes an outer surface 52 and an inner surface 54. Upper enclosure member upper end 148 is tapered to be frictionally fit within a receptacle (not shown) extending from chair seat 114. Upper enclosure member inner surface 154 defines a cavity 155 and includes a plurality of threads 156 that extend radially inward from inner surface 154 towards an axis of symmetry 158 for height adjustment mechanism 140. Axis of symmetry 158 extends from upper enclosure member first end 148 to upper enclosure second end 150. Upper enclosure member threads 156 extend along inner surface 154 from upper enclosure member lower end 150 towards upper end 148. In one embodiment, upper enclosure member 142 includes a spring (not shown) mounted to provide a pre-determined amount of downward travel of chair seat 14 when chair seat 14 is initially occupied.

Upper enclosure member cavity 155 has a diameter 160 measured with respect to inner surface 154 sized to receive lower enclosure member 144 therein. More specifically, lower enclosure member 144 is hollow and includes an outer surface 162 including a plurality of threads 164 which extend radially outward from outer surface 162. In addition, lower enclosure member 144 has an outer diameter 166 that is smaller than upper enclosure cavity diameter 155. More specifically, upper enclosure member cavity 155 and lower enclosure member 144 are sized such that as lower enclosure member 144 is received within upper enclosure member cavity 155, lower enclosure member threads 164 engage upper enclosure member threads 166.

Lower enclosure member 144 also includes an inner surface 170 that extends from an upper end 172 of lower enclosure member 144 to a lower end 174 of lower enclosure member 144. Threads 164 extend between upper and lower ends 172 and 174, respectively. Lower enclosure member inner surface 170 defines a cavity 176 that has a diameter 178 measured with respect to inner surface 170. A plurality of threads 181 extend radially inward from inner surface 170 between lower enclosure member upper and lower ends 172 and 174, respectively.

Lower enclosure member 144 also includes an upper stop 181 and a lower stop 182. Lower enclosure member upper stop 181 is adjacent lower enclosure upper end 172. As lower enclosure member 144 rotates within upper enclosure member 142, lower enclosure upper stop 181 contacts an upper enclosure member stop 184 to limit a distance that upper enclosure member 142 may extend towards chair seat 14 from chair base 12. Lower enclosure member lower stop 182 is adjacent lower enclosure lower end 174 and limits a distance that lower enclosure member 144 may extend towards chair seat 14 from chair base 12. Stops 181 and 182 prevent height adjustment mechanism 140 from over-rotating as chair seat 14 is raised and becoming forcibly stuck in a relative extended position that has exceeded a predetermined fully-extended position.

Lower enclosure member 144 is coupled to base 12 through a drive mechanism 190. Drive mechanism 190 includes an electric motor 192, a drive shaft 194, and a gear box 196. Electric motor 192 is coupled to gear box 196 which in turn is coupled to drive shaft 194. A combination of motor 192 and gear box 196 is known as a motor-gear group, similar to motor-gear groups 41 shown in FIG. 1. Electric motor 192 is known in the art and in one embodiment is commercially available from Dewert Motorized Systems, Frederick, Md., 21704-4300. More specifically, electric motor 192 and gear box 196 are coupled substantially perpendicularly to drive shaft 194. Drive shaft 194 is substantially co-axial with respect to upper and lower enclosure members 142 and 144, respectively.

Drive shaft 194 includes an outer surface 197 including a plurality of threads 198 extending radially outward from outer surface 197. Drive shaft 194 has an outer diameter 200 measured with respect to outer surface 197 that is smaller than lower enclosure member cavity diameter 178. More specifically, drive shaft diameter 200 is sized such that when drive shaft 194 is received within lower enclosure member 142, drive shaft threads 198 engage lower enclosure inner threads 180. Drive shaft 194 also includes a stop 202 adjacent to an upper end 204 of drive shaft 194. As drive shaft 194 rotates within lower enclosure member 144, lower enclosure member 144 is rotated within upper enclosure member 142 to raise or lower upper enclosure member 142 with respect to chair base 12. When upper enclosure member 142 is being raised, drive shaft stop 202 contacts lower enclosure member lower stop 182 to limit a distance that lower enclosure member 144 may extend towards chair seat 14 from chair base 12. Drive shaft 194 also includes a lower end 204 coupled to gear box 196. A load bearing 206 extends circumferentially around drive shaft 194 between gear box 196 and lower enclosure member 144.

A hollow guide sleeve 210 extends circumferentially around upper and lower enclosure members 142 and 144, and drive shaft 194. More specifically, guide sleeve 210 is co-axially aligned with respect to upper and lower enclosure members 142 and 144, and drive shaft 194, and has a first end 212 and a second end 214. Guide sleeve 210 has a height (not shown) such that guide sleeve first end 212 is between upper enclosure member upper and lower ends 148 and 150, respectively, and guide sleeve second end 214 is in proximity to gear box 196, such that load bearing 206 is between guide sleeve second end 214 and gear box 196.

Guide sleeve 210 also includes an anti-spin and side load collar 218, and an upper stop 220. During rotation of lower enclosure member 144, guide sleeve upper stop 220 works in combination with lower enclosure upper stop 181 and upper enclosure stop 184 to limit a distance that upper enclosure member 142 may extend towards chair seat 14 from chair base 12. Anti-spin and side load collar 218 includes channels (not shown) that extend lengthwise along guide sleeve 210 to prevent guide sleeve 210 from rotating as chair seat 14 is rotated. More specifically, because upper enclosure member 142 is frictionally coupled beneath chair seat 14, as chair seat 14 is rotated, upper enclosure member 142 rotates simultaneously with chair seat 14, and induces rotation into lower enclosure member 144. Anti-spin and side load collar 218 permits chair seat 14 to rotate without permitting guide sleeve 210 to rotate. In addition, as an occupant sits and moves around within chair seat 14, side loading forces induced into upper and lower enclosure members 142 and 144, respectively, are transmitted through guide sleeve 210 and anti-spin and side load collar 218 into chair base 12.

Anti-spin and side load collar 218 extends around guide sleeve 210 between guide sleeve 210 and a housing 224. Housing 224 has an upper surface 220 and a lower surface 222, and extends around guide sleeve 210 and anti-spin and side load collar 218. Housing 224 includes an upper portion 226 and a lower portion 228. Upper portion 226 is substantially circular and has an inner diameter 230 that is smaller than an outer diameter 232 of an opening 234 extending through base socket 28. Housing lower portion 228 has an outer diameter 236 that is larger than base socket opening 234.

A plurality of sensors 240 are mounted to housing upper surface 220 and receive signals from a switch (not shown) attached to chair seat 14. Sensors 240 detect when a pre-determined amount of resistance is induced into height adjustment mechanism 140 as chair seat 14 is raised. More specifically, sensors 240 are coupled to drive mechanism 190 and stop operation of electric motor 192 when a pre-determined amount of resistance is sensed. In one embodiment, sensors 240 are infrared sensors and receive an infrared signal transmitted from an infrared switch attached to chair seat 14. In a further embodiment, sensors 240 are commercially available from Dewert Motorized Systems, Frederick, Md., 21704.

Sensors 240 are coupled to a limit or resistance sensing switch 242. Limit switch 242 receives a signal from sensors 240 regarding a relative position of drive shaft 194 measured with respect to chair base 14. More specifically, limit switch 242 is electrically coupled to electric motor 192 and automatically stops a flow of electric current to motor 192 when drive shaft 194 nears a pre-set fully extended position.

Drive mechanism 190 is housed within housing 224 and is electrically coupled to a rechargeable battery 244. More specifically, a plurality of wires 246 couple battery 244 to electric motor 192 to permit battery 244 to supply power to motor 192. In addition, electric motor 192 is also coupled to a resistance sensing switch (not shown) which automatically stops a flow of electric current to motor 192 when a pre-determined amount of resistance is induced within height adjustment mechanism 140 as chair seat height $h_1$ (shown in FIG. 1) is adjusted. For example, the resistance sensing switch automatically stops a flow of electric current to motor 192 to prevent an occupant's legs (not shown) from being compressed between chair seat 14 and an underside (not shown) of a desk or table (not shown) as seat 14 is raised.

Rechargeable battery 244 is a 12 volt battery that is mounted within housing 224. In one embodiment, battery 244 provides greater than 12 volts. In another embodiment, battery 244 is mounted separately from housing 224 to facilitate removal and replacement for recharging purposes. Battery 244 may be, but is not limited to, a lead acid battery, a nickel metal hydride battery, a nickel cadmium battery, a lithium ion battery, or a lithium ion polymer battery. In one embodiment, a battery life indicator (not shown) is coupled to battery 244 to indicate when a useful life of battery 244 is decreasing, and battery 244 requires recharging.

During assembly, height adjustment mechanism 140 is initially assembled. More specifically, upper enclosure member 142 is coupled to lower enclosure member 144, and the assembly is inserted within housing 224. Limit switch 242 is coupled to either the upper enclosure member 142 or the lower enclosure member 144, and to electric motor 192.

Drive mechanism 190 is then coupled to lower enclosure member 144, and inserted within housing 224. More specifically, gear box 196 is coupled to drive shaft 194, and motor 192 is then coupled to gear box 196. Battery 244 is then coupled to motor 192 and inserted within housing 224.

Height adjustment mechanism 140 is then inserted within chair base socket 28 such that sensors 240 are in alignment with the switch sensor mounted on chair seat 14. Wires (not shown) are routed to a control mechanism switch (not shown) that is accessible by an occupant sitting in chair seat 14 for selectively adjusting chair seat height $h_1$ with respect to chair base 12.

When the seated occupant engages the control mechanism switch to raise chair seat 14 relative to chair base 12, electric motor 192 operates to rotate gear box 196. In one embodiment, the control mechanism switch incorporates the battery life indicator. In an alternative embodiment, housing 224 incorporates the battery life indicator. Because gear box 196 is coupled to drive shaft 194, drive shaft 194 rotates simultaneously with gear box 196. As drive shaft 194 is rotated, drive shaft threads 198 engage lower enclosure inner threads 180 and cause lower enclosure member 144 to rotate. As lower enclosure member 144 rotates, lower enclosure member outer threads 164 engage upper enclosure member threads 166 to cause upper enclosure member 142 to rotate, thus raising chair seat 14 relative to chair base 12.

Figure 3:
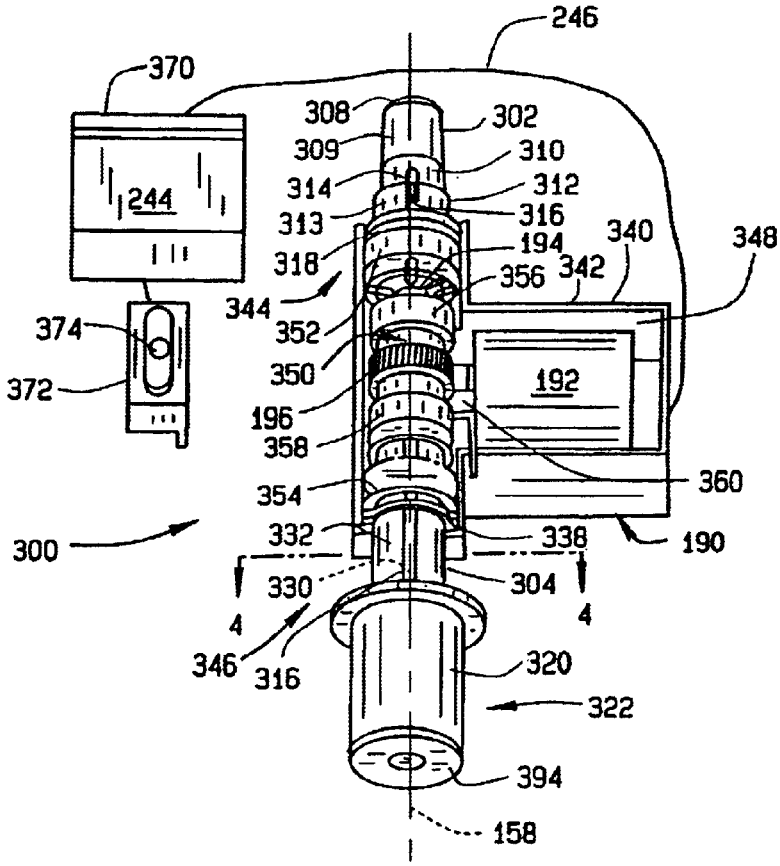
FIG. 3 is a partial cut-away side view of an alternative embodiment of a height adjustment mechanism that may be used with the chair shown in FIG. 1.

FIG. 3 is a partial cut-away side view of an alternative embodiment of a height adjustment mechanism 300 that may be used with chair 10 (shown in FIG. 1). Height adjustment mechanism 300 is similar to height adjustment mechanism 140, shown in FIG. 2, and components in height adjustment mechanism 300 that are identical to components of height adjustment mechanism 140 are identified in FIG. 3 using the same reference numerals used in FIG. 2. Accordingly, height adjustment mechanism 300 includes drive mechanism 190, including electric motor 192, drive shaft 194, and gear box 196. In addition, height adjustment mechanism 300 also includes an upper enclosure member 302 telescopically coupled to a lower enclosure member 304. More specifically, lower enclosure member 304 is coupled substantially co-axially to upper enclosure member 302 such that lower enclosure member 304 telescopes into upper enclosure member 302. Upper enclosure member 302 is coupled between chair seat 14 (shown in FIG.1) and lower enclosure member 304. Lower enclosure member 304 is between upper enclosure member 302 and chair base 12 (shown in FIG. 1). In one embodiment, upper enclosure member 302 and lower enclosure member 304 each have a substantially circular cross-sectional profile. In an alternative embodiment, upper enclosure member 302 and lower enclosure member 304 have non-circular cross sectional profiles.

Upper enclosure member 302 includes an upper end 308 and a lower end (not shown). Upper enclosure member upper end 308 is tapered to be frictionally fit within a receptacle (not shown) extending from chair seat 14. More specifically, upper enclosure member upper end 308 includes a chair control taper end 309. Chair control taper ends 309 are known in the art. In one embodiment, upper enclosure member upper end 308 also includes a spring (not shown) mounted in such a manner as to provide a predetermined amount of downward travel of chair seat 14 when chair seat 14 is initially occupied.

Upper enclosure member 302 includes a screw collar 310 and an anti-screw collar 312. In one embodiment, screw collar 310 and anti-screw collar 312 each have non-circular cross-sectional profiles. In an alternative embodiment, screw collar 310 and anti-screw collar 312 each have substantially circular cross-sectional profiles. In a further embodiment, screw collar 310 has a substantially round cross-sectional profile and anti-screw collar 312 has a substantially round inner cross-sectional profile defined by an inner surface (not shown) of anti-screw collar 312, and a non-circular outer cross sectional profile defined by an outer surface 313 of anti-screw collar 312.

Screw collar 310 extends circumferentially around drive shaft 194 and is threadingly engaged by drive shaft 194. Accordingly, when drive shaft 94 is rotated, screw collar 310 moves either towards chair seat 14 or towards lower enclosure member 304 depending upon a direction of rotation of motor 192 and drive shaft 194. Screw collar 310 includes a plurality of anti-twist channels (not shown) that extend lengthwise along screw collar 310. Screw collar 310 also includes a stop (not shown) adjacent an upper end (not shown) of screw collar 310. The screw collar upper end is coupled to upper enclosure upper end 308. The screw collar stop works in combination with drive shaft stop 102 (shown in FIG. 2) to limit a distance that upper enclosure member 302 may extend towards chair seat 14 from anti screw collar 312.

Anti-screw collar 312 also includes a plurality of anti-twist channels 316. Anti-twist collar channels 316 extend radially inward and mate with screw collar channels 314 to prevent screw collar 310 from rotating into anti-screw collar 312 when drive shaft 194 is rotated. Additionally, an upper key washer 318 extends circumferentially around anti-screw collar 312 and includes a plurality of projections (not shown) that mate with anti-twist collar channels 316 to prevent anti-screw collar 312 from rotating with respect to screw collar 310. As a result, when drive shaft 194 is rotated, screw collar 310 either moves upward and away from anti-screw collar 312 or moves towards anti-screw collar 312, depending upon the rotational direction of drive shaft 194. Furthermore, anti-screw collar 312 includes a stop flange adjacent screw collar 310 that prevents anti-screw collar 312 from over-rotating within anti-screw collar 312 and becoming stuck against anti-screw collar 312 when drive shaft 194 is rotated.

Figure 4:
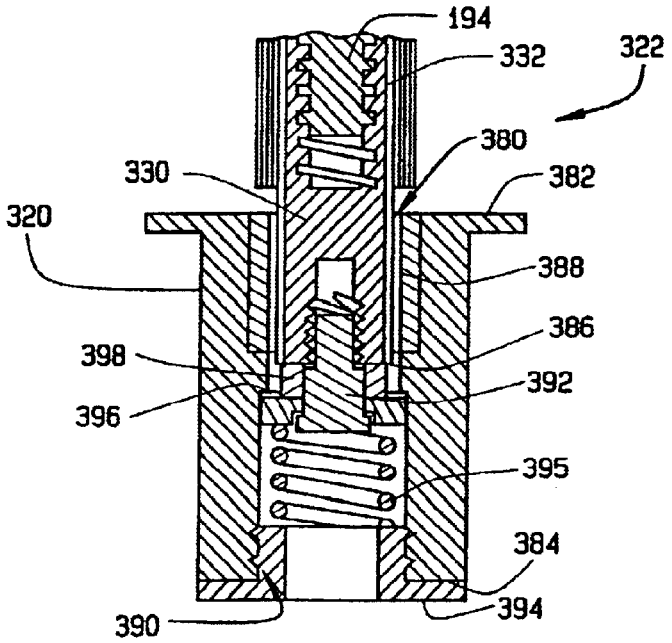
FIG. 4 is an enlarged cross-sectional view of the height adjustment mechanism shown in FIG. 3 and taken along line 4—4.

Lower enclosure member 304 includes an upper end (not shown) and a lower end 322 (shown in FIG. 4). Lower enclosure member lower end 322 is tapered to be frictionally fit within base center socket 28 (shown in FIG. 1). More specifically, lower enclosure member lower end 322 includes a swivel base socket 320 that permits chair seat 14 to rotate with respect to chair base 12.

Lower enclosure member 304 also includes a lower screw collar 330 and an anti-screw collar 332. In one embodiment, screw collar 330 and anti-screw collar 332 have substantially non-circular profiles. In an alternative embodiment, screw collar 330 and anti-screw collar 332 have substantially circular profiles. Screw collar 330 extends circumferentially around drive shaft 194 and is threadingly engaged by drive shaft 194. Accordingly, when drive shaft 194 is rotated, screw collar 330 moves either towards chair base 12 or towards upper enclosure member 302 depending upon a direction of rotation of motor 92 and drive shaft 194. Screw collar 330 includes a pluarality of anti-twist channels (not shown) that extend lengthwise along screw collar 330. Screw collar 330 also includes a stop (not shown) adjacent a lower end (not shown in FIG. 3) of screw collar 330. The screw collar lower end is coupled to lower enclosure lower end 322. The screw collar stop works in combination with a drive shaft stop (not shown) to limit a distance that lower enclosure member 304 may extend towards chair base 12 from anti screw collar 332.

Anti-screw collar 332 also includes a plurality of anti-twist channels 316. Anti-twist collar channels 316 extend radially inward and mate with the screw collar channels to prevent screw collar 330 from rotating into anti-screw collar 332 when drive shaft 194 is rotated. Additionally, a lower key washer 338 extends circumferentially around anti-screw collar 332 and includes a plurality of projections (not shown) that mate with anti-screw collar channels 316 to prevent anti-screw collar 332 from rotating with respect to screw collar 330. As a result, when drive shaft 194 is rotated, screw collar 330 either moves upward and away from anti-screw collar 332 or moves towards anti-screw collar 332, depending upon the rotational direction of drive shaft 94. Furthermore, anti-screw collar 332 includes a stop flange (not shown) adjacent screw collar 330 that prevents anti-screw collar 332 from over-rotating within anti-screw collar 332 and becoming stuck against anti-screw collar 332 when drive shaft 194 is rotated.

Upper and lower enclosure members 302 and 304, respectively, extend partially into a housing 340. Key washers 318 and 338 are between housing 340 and respective screw collars 310 and 330. More specifically, each key washer 318 and 338 is adjacent to an exterior surface 342 of housing 340 at a respective upper side 344 and lower side 346 of housing 340. Housing 340 also includes an inner surface 348 that defines a cavity 350. Upper and lower enclosure members 302 and 304, respectively, extend partially into housing cavity 350.

An upper and lower bushing 352 and 354, respectively, are each within housing cavity 350 and adjacent each respective key washer 318 and 338. In one embodiment, bushings 352 and 354 are rubber bushings. An upper and lower load bearing 356 and 358 are within housing cavity 350 and are adjacent each respective bushing 352 and 354. Bearings 356 and 358, bushings 352 and 354, and upper and lower enclosure members 302 and 304, respectively, are co-axially aligned.

Gear box 196 is coupled to drive shaft 194 within housing cavity 350 between load bearings 356 and 358. More specifically, gear box 196 is coupled substantially perpendicularly to drive shaft 194. Gear box 196 is also coupled to motor 192. A limit switch 360 is electrically coupled to electric motor 192 and automatically stops a flow of electric current to motor 192 when drive shaft 194 is rotated to a height $h_1$ (shown in FIG. 1) that is near a pre-set fully extended position.

Housing 340 extends circumferentially around axis of symmetry 158 such that drive mechanism 190 is disposed within housing cavity 350. Drive mechanism 190 is coupled to height adjustment mechanism 300 and receives power from rechargeable battery 244. Battery 244 is coupled to drive mechanism 190 with wires 246 which extend into housing 340 from a remote battery housing 370. Battery 244 is also coupled to a resistance sensing switch (not shown) which automatically stops a flow of electric current to motor 192 when a pre-determined amount of resistance is induced within height adjustment mechanism 300 as chair seat height $h_1$ (shown in FIG. 1) is adjusted. For example, the resistance sensing switch automatically stops a flow of electric current to motor 192 to prevent an occupant's legs (not shown) from being compressed between chair seat 14 and an underside (not shown) of a desk or table (not shown) as seat 14 is raised. Additionally, battery 144 is coupled to a control mechanism switch 372 that is accessible by an occupant sitting in chair seat 14. Control mechanism switch 372 permits selective adjustments of the chair seat height $h_1$ (shown in FIG. 1) to be made with respect to chair base 12. In the exemplary embodiment, control mechanism switch 372 is coupled to a battery life indicator 374 that illuminates when battery 244 needs recharging. In an alternative embodiment, battery life indicator 374 sounds an audible alarm when battery 244 needs recharging.

During use, as drive shaft 194 is rotated in a first direction to raise chair seat 14, both upper and lower enclosure screw collars 310 and 330 simultaneously move away from housing 340. More specifically, upper enclosure member screw collar 310 is moved towards chair seat 14, while lower enclosure member screw collar 330 is moved towards chair base 12. Reversing an operation of motor 192, reverses a rotation of drive shaft 194, and screw collars 310 and 330 move towards each other and towards housing 340 to lower chair seat 14.

FIG. 4 is a cross-sectional view of swivel base socket 320 along line 4—4. Swivel base socket 320 is hollow and includes an opening 380 that extends from an upper side 382 of swivel base socket 320 to a lower side 384 of swivel base socket 320. Opening 380 is sized to receive screw collar 330. More specifically, a lower end 386 of screw collar 330 extends into opening 380 and is circumferentially surrounded by an insert 388. In one embodiment, insert 388 is a Teflon® insert. Swivel base socket 320 is sized to provide side loading resistance to height adjustment mechanism 300.

Screw collar lower end 386 includes a threaded opening 390 sized to receive a fastener 392 used to secure screw collar to swivel base socket 320. In one embodiment, fastener 392 is a shoulder screw. Fastener 392 extends through a bushing 394 inserted into swivel base opening lower side 384. Bushing 394 includes a shock absorption spring 395 that is biased against fastener 392. Fastener 392 also extends through a hardened washer 396 and through a ball bearing assembly 398 positioned between bushing 394 and screw collar lower end 386.

Figure 5:
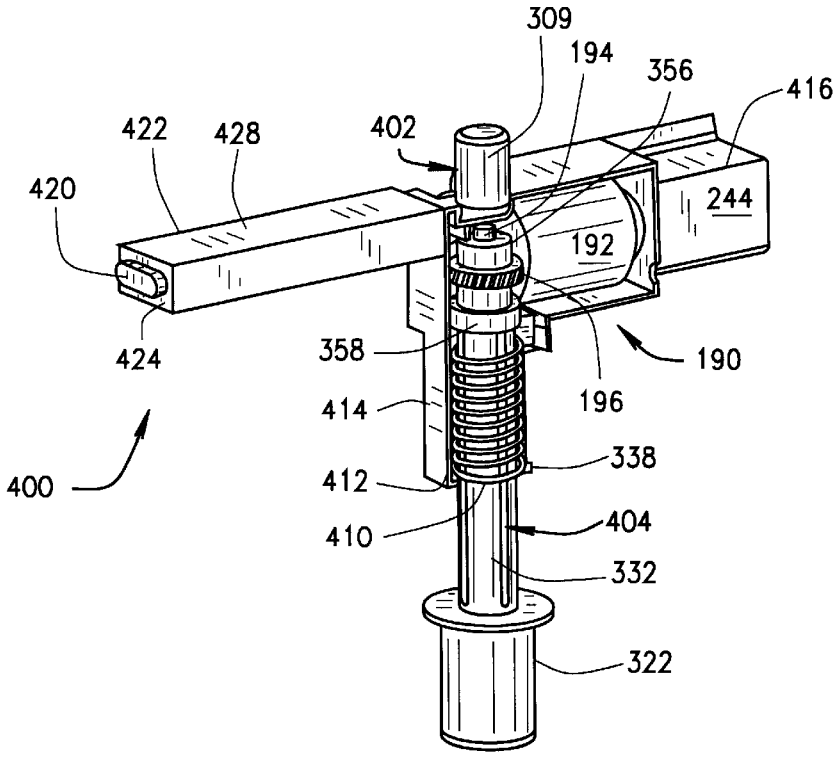
FIG. 5 is a partial cut-away side view of an alternative embodiment of a height adjustment mechanism that may be used with the chair shown in FIG. 1.

FIG. 5 is partial cut-away side view of an alternative embodiment of a height adjustment mechanism 400 that may be used with chair 10 (shown in FIG. 1). Height adjustment mechanism 400 is substantially similar to height adjustment mechanism 300 shown in FIGS. 3 and 4, and components in height adjustment mechanism 400 that are identical to components of height adjustment mechanism 300 are identified in FIG. 5 using the same reference numerals used in FIGS. 3 and 4. Accordingly, height adjustment mechanism 400 includes drive mechanism 190, including electric motor 192, drive shaft 194, and gear box 196. In addition, height adjustment mechanism 400 also includes an upper enclosure member 402 telescopically coupled co-axially to lower enclosure member 404. Upper and lower enclosure members 402 and 404, respectively are substantially similar to upper and lower enclosure members 302 and 304.

Upper enclosure member upper end 308 includes taper end 309, and lower enclosure member 404 includes anti-screw collar 332 and lower screw collar 330 (shown in FIGS. 3 and 4). Lower enclosure member lower end 320 also includes swivel base socket 322 and key washer 338. A stroke resistance spring 410 circumferentially surrounds lower enclosure member 404 and is between key washer 338 and a lower side 412 of a housing 414.

Gear box 196 is coupled to drive shaft 194 between bearings 356 and 358. More specifically, gear box 196 is coupled substantially perpendicularly to drive shaft 194 adjacent an upper end 416 of drive shaft 194. Limit switch 360 (shown in FIG. 3) is electrically coupled to electric motor 192 and automatically stops a flow of electric current to motor 192 when drive shaft 194 is rotated to a height (not shown) that is near a pre-set fully extended position.

Housing 414 is substantially similar to housing 340 (shown in FIGS. 3 and 4) and extends circumferentially around axis of symmetry 158 such that drive mechanism 190 is housed within housing 414. Drive mechanism 190 is coupled within height adjustment mechanism 400 to receive power from rechargeable battery 244. Battery 244 is not housed within housing 414, but is instead removably coupled to drive mechanism with wires (not shown) which extend into housing 414 from a separate battery housing 416. Battery 244 is also coupled to a resistance sensing switch (not shown) which automatically stops a flow of electric current to motor 192 when a pre-determined amount of resistance is induced into height adjustment mechanism 400 as chair seat height $h_1$ (shown in FIG. 1) is adjusted. For example, the resistance sensing switch automatically stops a flow of electric current to motor 192 to prevent an occupant's legs (not shown) from being compressed between chair seat 14 and an underside (not shown) of a desk or table (not shown) as seat 14 is raised. Additionally, battery 244 is coupled to a control mechanism switch 420 that is accessible by an occupant sitting in chair seat 14. Control mechanism switch 320 permits selective adjustments of chair seat height $h_1$ to be made with respect to chair base 12. In an alternative embodiment, battery 244 is coupled to motor 192 on an opposite side of gear box 196 than motor 192 is positioned.

Control switch 420 is coupled to housing 414. More specifically, housing 414 includes an arm 422 that extends radially outward from axis of symmetry 158, and is opposite electric motor 192 and battery 244. Control switch 420 is coupled to an end 424 of arm 422. In an alternative embodiment, housing 414 does not include arm 422 and control switch 420 is positioned remotely from housing 414 and height adjustment mechanism 400. Because gear box 196 is coupled substantially perpendicularly to drive shaft 194 at drive shaft upper end 416, upper enclosure member taper end 309 is adjacent an upper surface 428 of housing 414.

During use, as drive shaft 194 is rotated in a first direction to raise chair seat 14, lower enclosure screw collar 330 is rotated by drive shaft 194 and extends from housing 414 towards chair base 12. Reversing an operation of motor 192, reverses a rotation of drive shaft 194, and screw collars 330 moves towards housing 414, thus lowering a relative position of chair seat 14.

Figure 6:
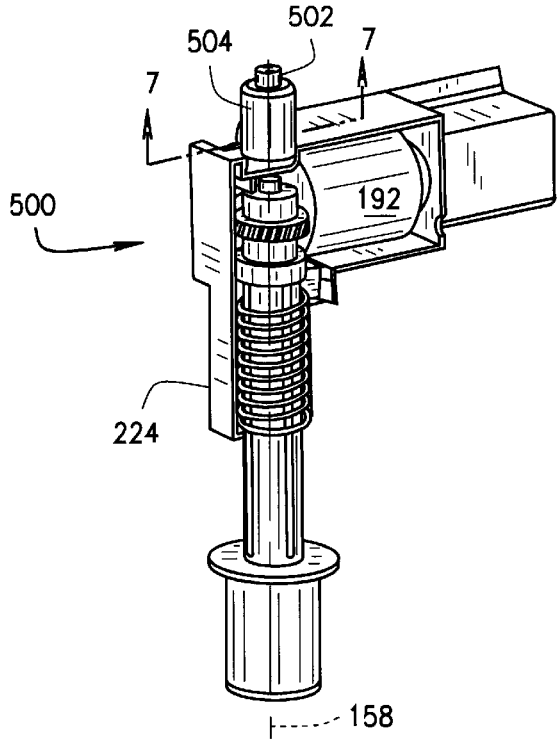
FIG. 6 is a partial cut-away side view of an alternative embodiment of a height adjustment mechanism that may be used with the chair shown in FIG. 1.
Figure 7:
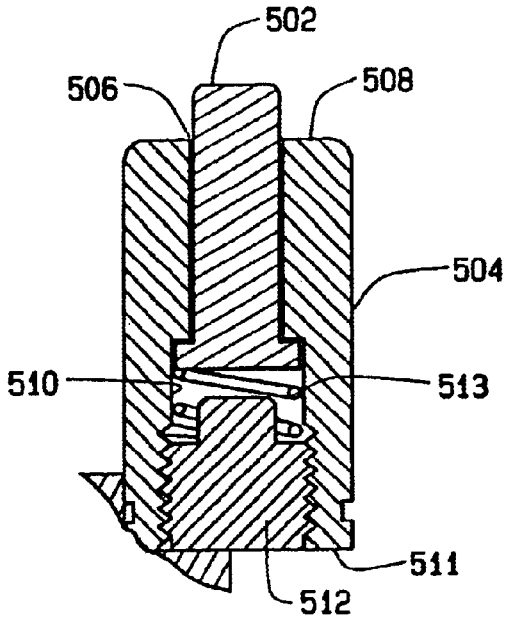
FIG. 7 is an enlarged cross-sectional view of the height adjustment mechanism shown in FIG. 6 and taken along line 7—7.

FIG. 6 is a partial cut-away side view of an alternative embodiment of a height adjustment mechanism 500 that may be used with chair 10 (shown in FIG. 1). FIG. 7 is an enlarged cross-sectional view of height adjustment mechanism 500 taken along line 7—7. Height adjustment mechanism 500 is substantially identical to height adjustment mechanism 400 shown in FIG. 5, and components in height adjustment mechanism 500 that are identical to components of height adjustment mechanism 400 are identified in FIGS. 6 and 7 using the same reference numerals used in FIG. 5. More specifically, height adjustment mechanism 500 does not include control switch 420, but rather upper enclosure member upper end 208 includes an actuation switch 402 that is formed integrally with a taper end 504.

Upper enclosure member taper end 504 is hollow and includes an opening 506 that extends from an upper surface 508 of taper end 504 to an internal surface 510 of taper end 504. Taper end 504 is tapered and is co-axially aligned with respect to axis of symmetry 158. A lower side 511 of taper end 504 is threaded and couples to a standard push button switch 512 included with known pneumatic cylinders, such as are commercially available from Stabilus, Colmar, Pa. A spring 513 is biased between push button switch 512 and actuation switch 502.

During use, when actuation switch 502 is depressed, spring 513 is depressed into push button switch 512. Accordingly, because push button switch 512 is electrically coupled to drive mechanism 190, when button switch 512 is depressed, electric motor 192 is activated, and remains activated as long as actuation switch 502 remains depressed. When actuation switch 502 is released and then re-depressed, motor 192 reverses rotation, and chair seat 14 (shown in FIG. 1) is moved in an opposite direction.

Figure 8:
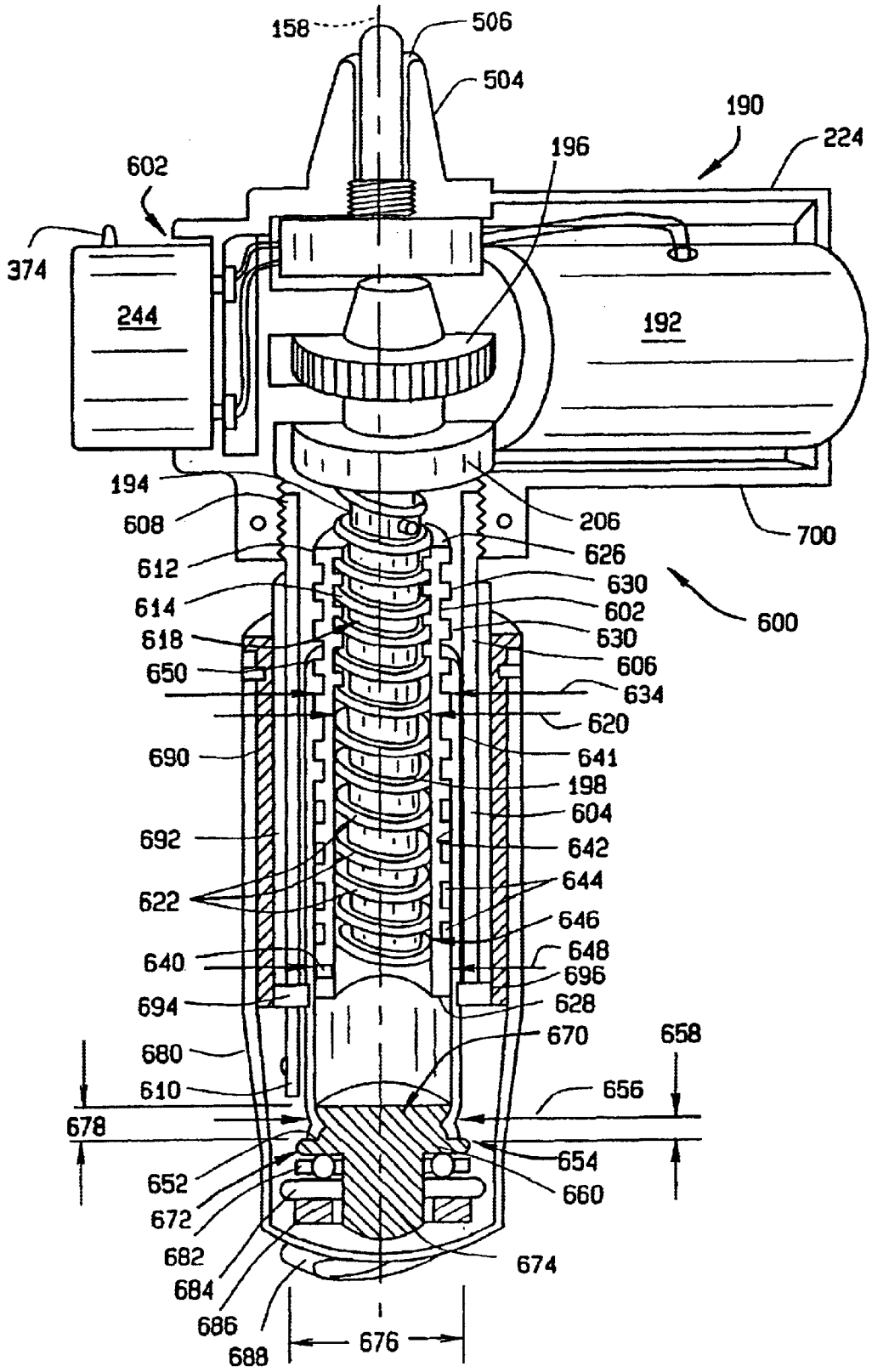
FIG. 8 is a cut-away side view of an alternative embodiment of a height adjustment mechanism that may be used with the chair shown in FIG. 1.

FIG. 8 is a cut-away side view of an alternative embodiment of a height adjustment mechanism 600 that may be used with chair 10 (shown in FIG. 1). Height adjustment mechanism 600 is substantially similar to height adjustment mechanism 500 shown in FIGS. 6 and 7, and to height adjustment mechanism 140 shown in FIG. 2, and components in height adjustment mechanism 600 that are identical to components of height adjustment mechanisms 140 and 500 are identified in FIG. 8 using the same reference numerals used in FIGS. 2, 6, and 7. Accordingly, height adjustment mechanism 600 includes taper end 504 including actuation switch 502, drive mechanism 190, and load bearing 206.

Height adjustment mechanism 600 also includes an upper enclosure member 602 telescopically coupled to a lower enclosure member 604. More specifically, lower enclosure member 604 is coupled substantially co-axially to upper enclosure member 602 such that upper enclosure member 602 telescopes into lower enclosure member 604. Upper enclosure member 602 is coupled between chair seat 14 (shown in FIG. 1) and lower enclosure member 604. Lower enclosure member 604 is coupled between upper enclosure member 602 and chair base 12. In one embodiment, upper enclosure member 602 has a substantially circular cross-sectional profile.

Upper enclosure member 602 includes a hollow guide sleeve 606, an upper end 608, and a lower end 610. In addition, upper enclosure member 602 includes an outer surface 612 and an inner surface 614. Guide sleeve 606 provides sideload resistance to height adjustment mechanism 600. In addition, guide sleeve 606 includes a plurality of anti-twist channels (not shown) that extend substantially length wise along outer surface 612.

Upper enclosure member inner surface 614 defines a cavity 618. Upper enclosure member cavity 618 has a diameter 620 measured with respect to inner surface 614, and is sized to receive drive shaft 194 therein. More specifically, upper enclosure member inner surface 614 includes a plurality of threads 622 that extend radially inward from inner surface 614 between an upper end 626 of upper enclosure member 602 and a lower end 628 of upper enclosure member 602. As drive shaft 194 is rotated into upper enclosure member cavity 618, drive shaft threads 198 engage upper enclosure member threads 622 and threadingly couple upper enclosure member 602 to drive shaft 194.

Upper enclosure member outer surface 612 includes a plurality of threads 630 that extend radially outward from outer surface 612 between upper enclosure member upper and lower ends 626 and 628, respectively. Upper enclosure member 602 has an outer diameter 634 measured with respect to outer surface 612. Upper enclosure member 602 also includes a lower stop 640 adjacent to upper enclosure member lower end 628.

Lower enclosure member 604 is hollow and includes an outer surface 641 and an inner surface 642 including a plurality of threads 644 which extend radially inward from inner surface 642. Inner surface 642 defines a cavity 646 that has a diameter 648 measured with respect to inner surface 642. Lower enclosure member cavity diameter 648 is larger than upper enclosure member outer diameter 634. Accordingly, lower enclosure member cavity 646 is sized to receive upper enclosure member 602 therein. More specifically, as upper enclosure member 602 is received within lower enclosure member cavity 646, lower enclosure member threads 644 engage upper enclosure member threads 630, such that lower enclosure member 604 is threadingly coupled to upper enclosure member 602.

Lower enclosure member 604 has an upper end 650 and a lower end 652. Lower enclosure member upper end 650 is threadingly coupled to upper enclosure member 602. Lower enclosure member lower end 652 is tapered to form a necked portion 654 that has an inner diameter 656. As a result, lower enclosure member necked portion diameter 656 is smaller than lower enclosure member cavity diameter 648. Lower enclosure member outer surface 641 includes a plurality of anti-twist channels (not shown) that extend between upper and lower ends 650 and 652, respectively.

Lower enclosure member necked portion 654 is a distance 658 from lower enclosure member lower end 652, and is sized to receive a fitting 660. More specifically, because lower enclosure member necked portion diameter 656 is smaller than lower enclosure member cavity diameter 648, when fitting 660 is inserted into lower enclosure member cavity 646 through lower enclosure member lower end 652, fitting 660 must be forcibly compressed to be fully inserted into lower enclosure member 604. More specifically, as fitting 660 is inserted into lower enclosure member lower end 652, necked portion 654 induces a compressive force into fitting 660. In one embodiment, fitting 660 is press fit into lower enclosure member lower end 652.

Fitting 652 includes a cavity portion 670, a shoulder portion 672, and a coupling portion 674. Fitting cavity portion 670 is inserted into lower enclosure member lower end 652 through lower enclosure member necked portion 654. Fitting shoulder portion 670 has an outer diameter 676 that is larger than lower enclosure member inner diameter 656, and accordingly, fitting shoulder portion 670 limits a depth 678 that fitting cavity portion 670 is inserted into lower enclosure member 604.

Fitting coupling portion 674 extends radially outwardly from fitting shoulder portion 672. More specifically, fitting coupling portion 674 is co-axially aligned with respect to axis of symmetry 158 and extends substantially perpendicularly from fitting shoulder portion 672 to couple with an outer housing 680 included with a known pneumatic cylinder, such as are commercially available from Stabilus, Colmar, Pa. More specifically, fitting coupling portion 674 extends from fitting shoulder portion 672 through a bearing 682, a hardened washer 684, and a rubber bushing 686 to a cylinder clip 688. Cylinder clip 688 is known in the art and couples fitting 652 to housing 680. In one embodiment, bearing 682 is a ball thrust bearing.

Housing 680 is known in the art and extends circumferentially around height adjustment mechanism 600. More specifically, housing 680 extends circumferentially around upper enclosure member guide sleeve 606. An insert guide 690 and an outer guide sleeve 692 also extend circumferentially around upper enclosure member guide sleeve 606. Outer guide sleeve 692 is between insert guide 690 and upper enclosure member guide sleeve 606, and insert guide 690 is between outer guide sleeve 692 and housing 680.

Outer guide sleeve 692 provides additional sideloading support to height adjustment mechanism 600 and includes a plurality of sleeve pins 694 that extend radially inward from a lower end 696 of outer guide sleeve 692. More specifically, upper enclosure member guide sleeve 606 includes channels (not shown) that extend circumferentially around guide sleeve 606 adjacent upper enclosure member guide sleeve lower end 610. The upper enclosure member guide sleeve channels are sized to receive outer guide sleeve pins 694, and thus permit height adjustment mechanism 600 and chair seat 14 to rotate relative to chair base 12. In addition, insert guide 690 includes anti-rotational channels (not shown) which enable insert guide 690 to mate with outer guide sleeve 692 to prevent outer guide sleeve 692 from rotating with respect to housing 680. Furthermore, a plurality of set screws 698 extend through housing 680 into insert guide 690.

A housing 700 extends circumferentially around axis of symmetry 158 such that upper enclosure member 602, lower enclosure member 604, and drive mechanism 190 are enclosed within housing 700. In one embodiment, housing 700 is fabricated from metal. In another embodiment, housing 700 is fabricated from plastic. In addition, housing 704 includes a receptacle 702 formed therein opposite motor 192 for receiving battery 244 therein. In one embodiment, taper end 404 is formed unitarily with housing 700.

Figure 9:
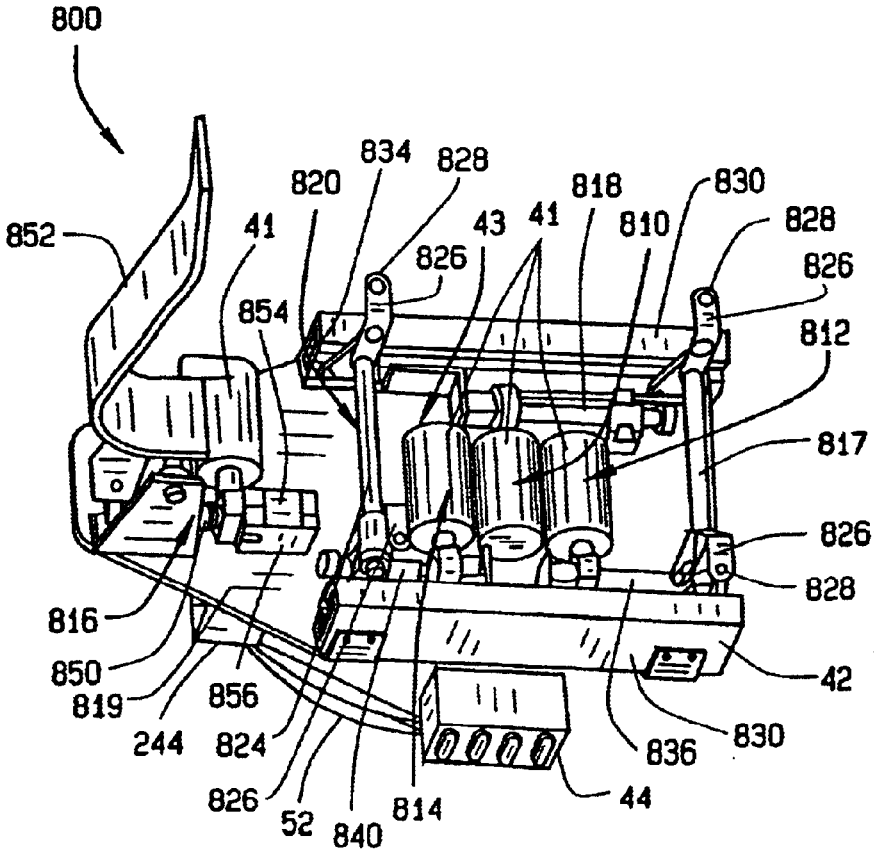
FIG. 9 is a top perspective view of an alternative embodiment of a control mechanism that may be used with the chair shown in FIG. 1.

FIG. 9 is a top perspective view of an alternative embodiment of a control mechanism 800 that may be used with chair 10 shown in FIG. 1. Control mechanism 800 is substantially similar to control mechanism 40 shown in FIG. 1, and components in control mechanism 800 that are identical to components of control mechanism 40 are identified in FIG. 9 using the same reference numerals used in FIG. 1. Accordingly, control mechanism 40 includes housing 42 and control panel 44.

Additionally, in the exemplary embodiment, control mechanism 800 includes four motor-gear groups 41 housed within control mechanism cavity 43 and coupled to control panel 44 with wiring 52. More specifically, control panel 44 is electrically coupled to rechargeable battery 244 and limit switch 242 (shown in FIGS. 2, 3, 5, 6, and 8). Each motor-gear group 41 includes a combination motor and gear-box that are substantially similar to motor 192 (shown in FIGS. 2, 3, 5, 6, and 8) and gear-box 196 (shown in FIGS. 2, 3, 5, 6, and 8), but motor-gear groups 41 do not operate to adjust chair seat height $h_1$ (shown in FIG. 1).

More specifically, control mechanism 800 includes a first motor-gear group 810, a second motor-gear group 812, a third motor-gear group 814, and a fourth motor-gear group 816. First motor-gear group 810 permits adjustments of chair seat tilt angle $\gamma$ (shown in FIG. 1). First motor-gear group 810 is substantially similar to the combination of motor 192 and gear box 196, but is not housed integrally within each respective height adjustment mechanism 140, 300, 400, 500, and 600 (shown in FIGS. 2, 3, 5, 6, and 8). Rather, first motor-gear group 810 is housed within control mechanism housing 42 and is selectively operated to adjust chair seat tilt angle $\gamma$ with respect to control mechanism housing 42. First motor-gear group 810 is coupled to a carriage assembly forward traverse support 817. More specifically, first motor-gear group 810 is threadingly coupled to a drive shaft 818 that is secured to a base plate 819 of control mechanism 800.

As first motor-gear group 810 is actuated, drive shaft 818 is rotated in a first direction, and carriage assembly forward traverse support 817 is rotated, such that chair seat forward edge 70 (shown in FIG. 1) is moved away from control mechanism base plate 819. Accordingly, as chair seat forward edge 70 is raised, chair seat tilt angle $\gamma$ is adjusted. Operation of first motor-gear group 810 is reversible, such that chair seat tilt angle $\gamma$ may increase or decrease with respect to chair seat 12.

Second motor-gear group 812 is housed within control mechanism cavity 43 and is selectively operated to adjust a depth $d_1$ (shown in FIG. 1) of chair seat 14 with respect to chair back support 90 (shown in FIG. 1). Second motor-gear group 812 is coupled to a carriage assembly 820 that includes forward traverse support 817 and a rear traverse support 824. Supports 817 and 824 include seat mounting tabs 826 including openings 828 for receiving fasteners (not shown) for securing chair seat 14 to control mechanism 800. In one embodiment, supports 817 and 824 are coupled to mounting tabs 826 in a cam-like configuration, such that rotation of supports 817 and 824 causes mounting tabs 826 to either raise or lower relative to control mechanism base plate 819.

Supports 817 and 824 are slidingly coupled to base tracks 830 extending from control mechanism base plate 819. More specifically, control mechanism base plate 819 defines control mechanism lower side 56, and each base track extends substantially perpendicularly from base plate 819 towards control mechanism upper side 54. Each support 817 and 824 is coupled substantially perpendicularly to base tracks 830. Each base track 830 includes a channel 834 sized to receive rollers (not shown) extending from each support mounting tabs 826.

Second motor-gear group 812 is threadingly coupled to at least one drive shaft 836 that is secured to control mechanism base plate 819. Accordingly, as second motor-gear group 812 is actuated, drive shaft 836 is rotated in a first direction, and carriage assembly 820 is moved laterally across control mechanism 800. More specifically, as second motor-gear group 812 is operated, chair seat 14 is moved laterally, such that chair seat depth $d_1$ measured with respect to chair back support 90 is changed. Operation of second motor-gear group 812 is reversible, such that chair seat depth $d_1$ may increase or decrease with respect to chair back support 90.

Third motor-gear group 814 is housed within control mechanism cavity 43 and is selectively operated to adjust chair seat tilt angle θ (shown in FIG. 1) with respect to control mechanism housing 42. Third motor-gear group 814 is coupled to carriage assembly rear traverse support 824. More specifically, third motor-gear group 814 is threadingly coupled to a drive shaft 840 that is secured to control mechanism base plate 819.

As third motor-gear group 814 is actuated, drive shaft 840 is rotated in a first direction, and carriage assembly rear traverse support 824 is rotated, such that chair seat rear edge 72 (shown in FIG. 1) is moved away from control mechanism base plate 819. Accordingly, as chair seat rear edge 72 is raised, chair seat tilt angle θ is adjusted. Operation of third motor-gear group 814 is reversible, such that chair seat tilt angle θ may increase or decrease with respect to chair seat 12.

Simultaneous operation of first and third motor-gear groups 810 and 814, respectively, permits adjustments of chair seat height $h_2$ with respect to control mechanism housing 42. More specifically, as first and third motor-gear groups, respectively, are operated, carriage assembly forward and rear traverse supports 817 and 824, respectively, are rotated, causing chair seat rear and forward edges 72 and 70, respectively, to simultaneously be raised, such that chair seat height $h_2$ is adjusted. Because operation of first and third motor-gear groups 810 and 814, respectively, are reversible, such that chair seat height $h_2$ may increase or decrease with respect to control mechanism housing 42.

Fourth motor-gear group 816 is housed within control mechanism cavity 43 and is selectively operated to adjust chair back support angle β (shown in FIG. 1) with respect to chair seat 14. Fourth motor-gear group 816 is threadingly coupled to a drive shaft 850 that is secured to control mechanism base plate 832. Drive shaft 850 is also coupled to a back support bracket 852 that is secured to chair back support 90, and to a biasing mechanism 854. In the exemplary embodiment, biasing mechanism 854 is a spring contained within a housing 856 attached to base plate 832. Biasing mechanism 854 permits chair back support 90 to deflect slightly through chair seat support angle β when a seated occupant leans against chair back support 90.

As fourth motor-gear group 816 is actuated, drive shaft 850 is rotated in a first direction, and back support bracket 852 is rotated in a first direction such that chair back support 90 is moved towards chair front edge 70 (shown in FIG. 1). Accordingly, as chair back support bracket 852 is rotated, chair seat back support angle β is adjusted. Operation of fourth motor-gear group 816 is reversible, such that chair seat back support angle β may increase or decrease with respect to chair seat 12. In one embodiment, chair 10 includes at least one microchip or memory device (not shown) that is electrically coupled to control mechanism 800, and permits an occupant to adjust chair 10 to a desired orientation that is retained by the microchip. If chair 10 is then adjusted to a different orientation, the occupant may activate the microchip to automatically return chair 10 to the desired orientation that was retained. In a further embodiment, chair 10 includes a microchip or memory device that is electrically coupled to control mechanism 800, and automatically adjusts chair 10 when chair 10 has been occupied for a pre-determined amount of time, to facilitate improving occupant ergonomics and reducing occupant fatigue that may be caused as a result of an occupant remaining in the same seated orientation for extended periods of time.

Figure 10:
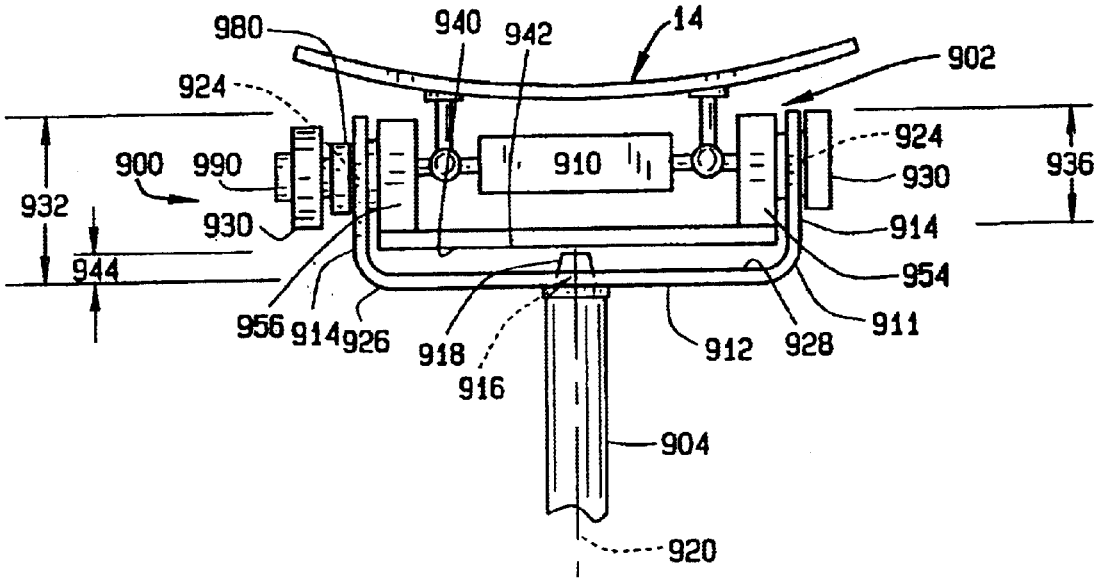
FIG. 10 is a front elevational view of a mounting assembly that may be used with the chair shown in FIG. 1.
Figure 11:
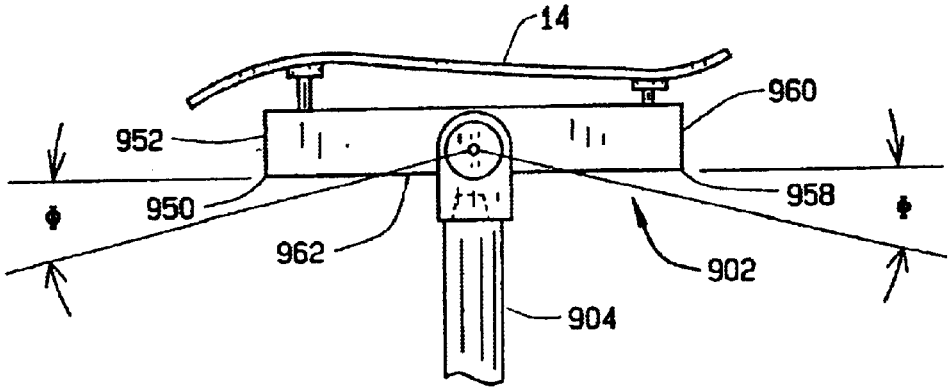
FIG. 11 is a side elevational view of the mounting assembly shown in FIG. 10.

FIG. 10 is a front elevational view of a mounting assembly 900 that may be used with chair 10 (shown in FIG. 1). FIG. 11 is a side elevational view of mounting assembly 900. Mounting assembly 900 couples a control mechanism 902 to a height adjustment mechanism 904. Control mechanism 902 is substantially similar to control mechanism 800 (shown in FIG. 9) or control mechanism 40 (shown in FIG. 1), and includes a plurality of motor-gear groups 910 electrically coupled to chair 10 for electrically adjusting a position of chair 14, as described above.

Mounting assembly 900 includes a mounting bracket 911 that is substantially U-shaped, and includes a center body portion 912 and a pair of sidewalls 914 that extend substantially perpendicularly from center body portion 912. In one embodiment, sidewalls 914 are formed integrally with center body portion 912. Center body portion 912 includes an opening 916 sized to receive height adjustment mechanism 904. Height adjustment mechanism 904 extends between chair base 12 (shown in FIG. 1) and chair 10, and is substantially similar to height adjustment mechanism 18 (shown in FIG. 1), height adjustment mechanism 140 (shown in FIG. 2), height adjustment mechanism 300 (shown in FIGS. 3 and 4), height adjustment mechanism 400 (shown in FIG. 5), height adjustment mechanism 500 (shown in FIGS. 6 and 7), or height adjustment mechanism 600 (shown in FIG. 8).

Height adjustment mechanism 904 includes a tapered upper end or swivel base socket 918 that extends at least partially through mounting bracket center body portion opening 916. More specifically, center body opening 916 is rotatably coupled to height adjustment mechanism 904, and accordingly enables height adjustment mechanism 904 to couple with chair 10. Mounting bracket opening 916 is concentrically aligned with an axis of symmetry 920 extending longitudinally through height adjustment mechanism 904.

Bracket sidewalls 914 are identical and each extends substantially perpendicularly from center body portion 912.

Each sidewall 914 includes an opening 924 extending between an outer surface 926 of bracket 911 and an inner surface 928 of bracket 911. A pair of fastener assemblies 930 extend through bracket sidewall openings 924 to pivotally couple mounting assembly 900 to control mechanism 902. More specifically, bracket sidewalls 914 extend from center body portion 912 a distance 932 that is greater than a height 934 of a sidewall 936 of a control mechanism 902. Accordingly, when control mechanism 902 is coupled to mounting assembly 900, control mechanism 902 is suspended within mounting bracket 911 by fastener assemblies 930. More specifically, because control mechanism 902 is suspended, an outer surface 940 of a control mechanism housing base plate 942 is a distance 944 above an axis of symmetry (not shown) extending through mounting bracket center body portion 912 between mounting bracket sidewalls 914.

Control mechanism 902 includes a front lower edge 950 defined between a front wall 952 of control mechanism 902 and opposing sidewalls 954 and 956 of mechanism 902. Control mechanism 902 also includes a rear lower edge 958 defined between a rear wall 960 of mechanism 902 and housing sidewalls 954 and 956. A lower surface 962 of mechanism 902 extends between housing lower edges 950 and 958 and is substantially planar. When control mechanism 902 is coupled to mounting assembly 900, control mechanism housing lower surface 962 is biased to be substantially perpendicularly to height adjustment mechanism axis of symmetry 920. Because control mechanism 902 is pivotally coupled to mounting bracket 911, housing rear lower edge 958 or housing forward lower edge 950 may be adjusted in a clockwise or counter-clockwise direction relative to fastener assemblies 930. Specifically, non-electrically powered adjustments may be made to an angle Φ of tilt of control mechanism 902 with respect to mounting bracket 911. Accordingly, because seat 14 is coupled to mechanism 902, seat 14 is also tilted at an angle Φ as control mechanism 902 is mechanically adjusted.

Manual adjustments to an angle Φ of tilt of control mechanism 900 are independent, as described in more detail below, to electronic adjustments of an angle θ (shown in FIG. 1) of tilt of chair seat 14. Although pivotally coupled to mounting bracket 911, control mechanism 900 is biased such that control mechanism housing lower surface 962 remains substantially perpendicularly to height adjustment mechanism axis of symmetry 920. More specifically, a tension control device 980 extends through at least one fastener assembly 930 to bias control mechanism 902 to mounting bracket 911. In one embodiment, tension control device 980 includes a helical tension spring. Fastener assemblies 930 also include a plurality of stops (not shown) which limit an amount of angle Φ of tilt of control mechanism 902 relative to mounting bracket 911.

Tension control device 980 adjustably couples mounting bracket 911 to control mechanism 902 such that an amount of resistance bias between mounting bracket 911 and control mechanism 902 is selectable by an occupant of chair 10. Tension control device 980 permits mechanical adjustments of an angle Φ of tilt of control mechanism 900 that are independent of electronic adjustments of an angle θ of tilt of chair seat 14. More specifically, because mounting bracket 911 is only connected mechanically to control mechanism 900 through fastener assemblies 930 and tension control device 980, control mechanism 900 may be adjusted mechanically through angles Φ of tilt when weight is applied to chair seat 14, depending on an amount of resistance selected for tension control device 980. Accordingly, depending on an amount of resistance selected for tension control device 980, a chair occupant may make mechanical adjustments to chair seat 14 without engaging motor-gear groups 910.

At least one fastener assembly 930 includes a lock-in/lock-out button 990. Lock-in/lock-out button 990 enables mounting assembly 900 to be selectively coupled to control mechanism 902 to prevent chair seat 14 from being adjusted independently of control mechanism 902. In one embodiment, lock-in/lock-out button 990 is spring activated. More specifically, when button 900 is engaged, control mechanism 902 becomes rigidly affixed to mounting bracket 911 such that independent mechanical adjustments of control mechanism 902 with respect to mounting bracket 911 are prevented, and chair seat 14 is only adjustable electrically using control mechanism 902. Control mechanism 902 remains rigidly affixed to mounting bracket 911 until lock-in/lock-out button 990 is disengaged. In an alternative embodiment, lock-in/lock-out button 990 is secured to a rectangularly-shaped lever or handle extending radially outwardly from mounting bracket 911.

Figure 12:
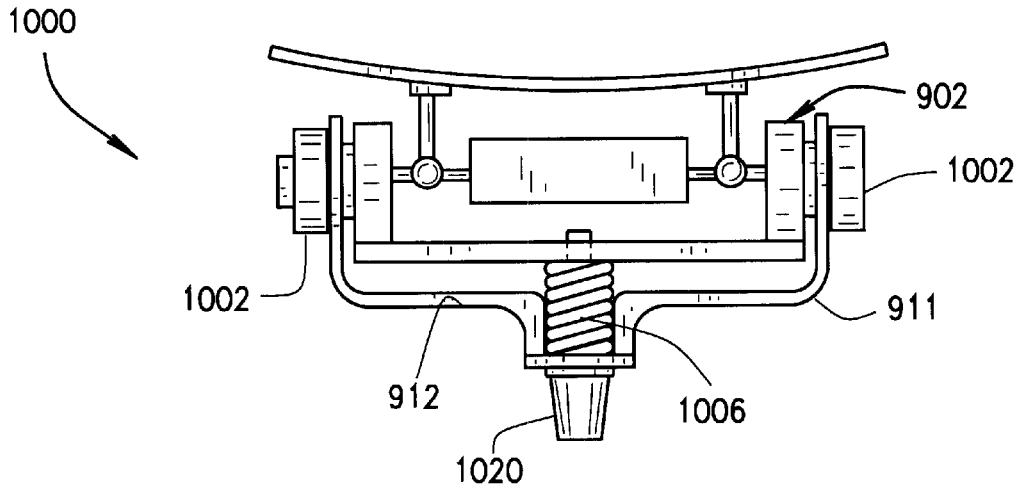
FIG. 12 is a front elevational view of an alternative embodiment of a mounting assembly that may be used with the chair shown in FIG. 1.
Figure 13:
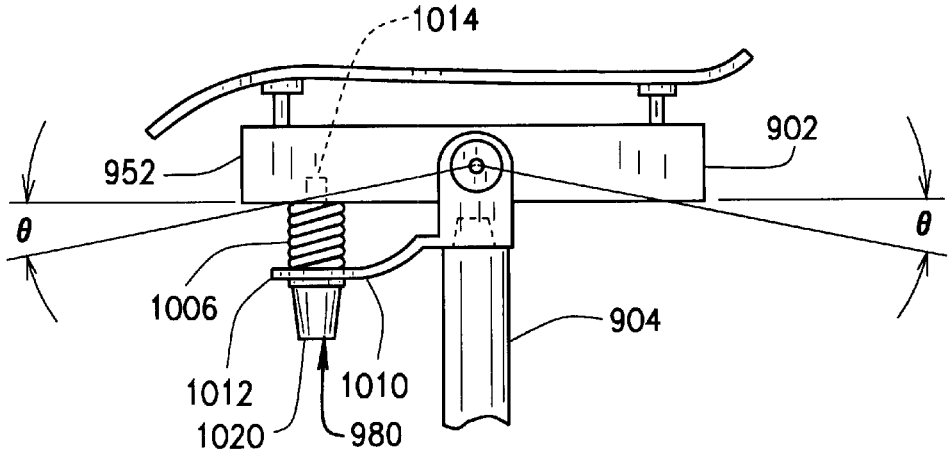
FIG. 13 is a side elevational view of the mounting assembly shown in FIG. 12.

FIG. 12 is a front elevational view of an alternative embodiment of a mounting assembly 1000 that may be used with chair 10 (shown in FIG. 1). FIG. 13 is a side elevational view of mounting assembly 1000. Mounting assembly 1000 is substantially similar to mounting assembly 900 shown in FIGS. 10 and 11, and components in control mechanism 1000 that are identical to components of control mechanism 900 are identified in FIGS. 12 and 13 using the same reference numerals used in FIGS. 10 and 11. Accordingly, mounting assembly 1000 couples control mechanism 902 to height adjustment mechanism 904, and includes mounting bracket 911.

A pair of fastener assemblies 1002 extend through bracket sidewall openings 924 to pivotally couple mounting assembly 1000 to control mechanism 902, such that control mechanism 902 is suspended within mounting bracket 911 by fastener assemblies 1002. Fastener assemblies 1002 are substantially identical with fastener assemblies 930 (shown in FIGS. 10 and 11), and include a plurality of stops (not shown) which limit an amount of angle Φ of tilt of control mechanism 902 relative to mounting bracket 911, but do not include tension control device 980. Rather, mounting assembly 1000 includes a tension control device 1006 that is separate from fastener assemblies 1002.

Tension control device 1006 is coupled to a spring bracket 1010 that extends radially outwardly from mounting bracket center body portion 912 towards control mechanism housing front wall 952. A forward side 1012 of spring bracket 1010 includes an opening (not shown) used to couple tension control device 1006 to spring bracket 1010. More specifically, tension control device 1006 extends between spring bracket 1010 and a tension control device receptacle 1014 within control mechanism 902. In one embodiment, tension control device 1006 includes a coil spring.

Tension control device 1006 permits manual adjustments to an angle Φ of tilt of control mechanism 1000 that are independent of electronic adjustments of an angle θ (shown in FIG. 1) of tilt of chair seat 14. Tension control device 1010 biases control mechanism 902 to mounting bracket 911. More specifically, tension control device 980 adjustably couples mounting bracket 911 to control mechanism 902 such that an amount of resistance bias between mounting bracket 911 and control mechanism 902 is selectable by an occupant of chair 10. Tension control device 1006 permits mechanical adjustments of an angle Φ of tilt of control mechanism 1000 that are independent of electronic adjustments of an angle θ of tilt of chair seat 14. More specifically, because mounting bracket 911 is only connected mechanically to control mechanism 1000 through fastener assemblies 930 and tension control device 1006, control mechanism 1000 may be adjusted mechanically through angles Φ of tilt when weight is applied to chair seat 14, depending on an amount of resistance selected for tension control device 980. Accordingly, depending on an amount of resistance selected for tension control device 980, a chair occupant may make mechanical adjustments to chair seat 14 without engaging motor-gear groups 910. In an alternative embodiment, lock-in/lock-out button 990 is secured to tension control device 1006.

The above-described mounting assembly for a chair is cost effective and highly reliable. The mounting assembly includes a mounting bracket that is pivotally coupled to the control mechanism, and permits mechanical adjustments of the chair seat to be made independently of the electrical adjustments available by the control mechanism. As a result, the combination of the mechanical adjustments and the electric adjustments permit a chair occupant to adjust the chair through a wide range of adjustments in a cost-effective and reliable manner.

While the invention has been described in terms of various specific embodiments, those skilled in the art will recognize that the invention can be practiced with modification within the spirit and scope of the claims.

What is claimed is:

1. An adjustable chair comprising:

a seat;

a pedestal base;

a control mechanism comprising a plurality of motor-gear groups comprising at least a first motor-gear group selectively operable to electrically adjust a position of said seat relative to said pedestal base, said control mechanism electrically coupled to a limit switch configured to limit an amount of adjustment of said seat and a resistance sensing switch configured to control power to said plurality of motor-gear groups;

a mounting assembly comprising a swivel bracket coupling said control mechanism to said pedestal base, said swivel bracket selectively engageable to mechanically change a position of said seat relative to said pedestal base.

2. An adjustable chair in accordance with claim 1 wherein said swivel bracket configured to mechanically change an angular orientation of said seat relative to said pedestal base.

3. An adjustable chair in accordance with claim 1 wherein said swivel bracket configured to change an angular orientation of said seat independently of said control mechanism.

4. An adjustable chair in accordance with claim 1 wherein said swivel bracket mechanically changes a position of said seat in proportion to an amount of weight applied to said seat by an occupant of said seat.

5. An adjustable chair in accordance with claim 1 wherein said seat comprises a forward edge and a rear edge, said swivel bracket configured to change an angular orientation of said seat such that at least one of said seat forward edge and said seat rear edge is moveable towards said pedestal base.

6. An adjustable chair in accordance with claim 1 wherein said mounting assembly further comprises a tension control device coupled to said swivel bracket.

7. An adjustable chair in accordance with claim 6 wherein said tension control device configured to control an amount of mechanical movement of said seat relative to said pedestal base.

8. An adjustable chair in accordance with claim 6 wherein said tension control device comprises a helical tension spring.

9. An adjustable chair in accordance with claim 6 wherein said tension control device comprises a coil spring.

10. An adjustable chair in accordance with claim 1 wherein said mounting assembly further comprises at least one stop configured to limit an amount of movement of said swivel bracket.

11. An adjustable chair in accordance with claim 1 wherein said mounting assembly further comprises a lock mechanism configured to selectively couple said swivel bracket to said control mechanism to prevent said swivel bracket from changing an angular orientation of said seat independently of said control mechanism.

12. An adjustable chair in accordance with claim 1 wherein said control mechanism electrically coupled to a rechargeable battery.

13. An adjustable chair in accordance with claim 1 wherein an operation of each said motor-gear group is reversible.

14. An adjustable chair in accordance with claim 1 wherein said mounting assembly is between said pedestal base and said control mechanism.

15. An adjustable chair in accordance with claim 1 wherein said control mechanism is between said mounting assembly and said chair seat.

16. An apparatus configured to be coupled to a chair seat supported by a pedestal base and coupled to a control mechanism including at least one motor-gear group coupled to a limit switch and a resistance sensing switch, said apparatus comprising a bracket and at least one stop, said bracket rotatably coupled to the control mechanism and selectively engageable to mechanically change a position of the chair seat relative to the pedestal base, said apparatus stop configured to limit an amount of movement of the chair seat by said apparatus wherein said resistance sensing switch configured to control power to said at least one motor-gear group.

17. Apparatus in accordance with claim 16 wherein said bracket selectively engageable to change an angular orientation of the chair seat relative to the pedestal base.

18. Apparatus in accordance with claim 17 wherein said apparatus further comprises an adjustable tension control device configured to selectively control an amount of mechanical movement of the chair seat relative to the pedestal base.

19. Apparatus in accordance with claim 18 wherein said tension control device coupled to said apparatus bracket.

20. Apparatus in accordance with claim 18 wherein said tension control device comprises at least one of a coil spring and a helical tension spring.

21. Apparatus in accordance with claim 17 further comprising a lock mechanism configured to selectively couple said apparatus bracket to the control mechanism to prevent said apparatus from moving the chair seat independently of the control mechanism.

22. Apparatus in accordance with claim 21 wherein said lock mechanism comprises a biasing device configured to maintain a position of said lock mechanism relative to the control mechanism.

23. Apparatus in accordance with claim 17 wherein said bracket has a substantially U-shaped cross-sectional profile.

24. Apparatus in accordance with claim 17 wherein said bracket between the control mechanism and a height adjustment mechanism.

25. A control mechanism for a chair including a base, a seat, and a back, said control mechanism comprising:

a mounting bracket;

a plurality of motor-gear groups comprising at least one first motor-gear group and a second motor-gear group, said first motor-gear group configured to electrically adjust a position of the chair seat with respect to the chair base, said second motor gear-group configured to electrically adjust a position of the chair back with respect to the chair seat; and at least one control switch coupled to each said motor-gear group for controlling operation of said plurality of motor-gear groups, said control switch further coupled to a limit switch configured to limit an amount of height adjustment of the chair seat with respect to the chair base and a resistance sensing switch configured to control power to said plurality of motor-gear groups, said plurality of motor-gear groups coupled to the chair base with said mounting bracket, said mounting bracket configured to permit adjustments of the chair seat position with respect to the chair base independently of said motor-gear groups.

26. A control mechanism in accordance with claim 25 wherein said first motor-gear group configured to electrically adjust an angular orientation of the chair seat relative to the chair base, said mounting assembly configured to mechanically adjust an angular orientation of the chair seat relative to the chair base.

27. A control mechanism in accordance with claim 26 further comprising a third motor-gear group configured to adjust an angular orientation of the chair back relative to the chair seat.

28. A control mechanism in accordance with claim 26 further comprising a third motor-gear group configured to adjust a lateral position of the chair seat relative to the chair back.

29. A control mechanism in accordance with claim 26 wherein said mounting bracket further configured to permit adjustments to the chair seat relative to the chair base in proportion to an amount of weight applied to the chair seat by an occupant of the chair seat.

30. A control mechanism in accordance with claim 26 further comprising a tension control device coupled to said mounting bracket and configured to control an amount of movement of the chair seat independently of the control mechanism motor-gear groups.

31. A control mechanism in accordance with claim 30 wherein said tension control device comprises at least one of a coil spring and a helical tension spring.

32. A control mechanism in accordance with claim 26 wherein an operation of each said motor-gear group is reversible.

33. A control mechanism in accordance with claim 26 wherein said motor-gear groups coupled to a rechargeable battery.

34. A method for assembling an adjustable chair including a seat supported by a pedestal base, and a control mechanism including a plurality of motor-gear groups, said method comprising:

coupling a control mechanism including at least a first motor-gear group to the chair seat to selectively electrically adjust a position of the seat relative to the pedestal base;

coupling a limit switch to the control mechanism to limit an amount of adjustment movement of the chair seat relative to the pedestal base; coupling a resistance sensing switch to the control mechanism to control power to the at least a first motor-gear group; and coupling a mounting bracket to the control mechanism and to the chair seat, such that the chair seat is mechanically adjustable relative to the pedestal base, and independently of the control mechanism.

35. A method in accordance with claim 34 wherein said step of coupling a control mechanism further comprises the step of coupling the first motor-gear group to the chair seat to electrically control an angular orientation of the chair seat relative to the pedestal base.

36. A method in accordance with claim 34 further comprising the step of coupling at least a second motor-gear group to the chair seat to electrically adjust a height of the chair seat relative to the pedestal base.

37. A method in accordance with claim 34 further comprising the step of coupling at least a second motor-gear group to the chair seat to electrically adjust a lateral position of the seat relative to the pedestal base.

38. A method in accordance with claim 37 wherein the chair includes a chair back coupled to the chair seat, the seat includes a forward edge and a rear edge, the rear edge between the forward edge and the chair back, said step of coupling at least a second motor-gear group to the chair seat to adjust a lateral position further comprising the step coupling the second motor-gear group to the chair seat to electrically adjust a distance between the chair rear edge and the chair back.

39. A method in accordance with claim 34 further comprising the step of coupling the control mechanism to a rechargeable battery pack for supplying power to the control mechanism.

40. A method in accordance with claim 34 wherein said step of coupling a mounting bracket further comprises the step of coupling the mounting bracket to the control mechanism to mechanically control an angular orientation of the chair seat relative to the pedestal base.

41. A method in accordance with claim 40 wherein said step of coupling a mounting bracket further comprises the step of coupling the mounting bracket to the seat such that a position of the chair is changed in proportion to an amount of weight applied to the seat by an occupant of the seat.

42. A method in accordance with claim 34 further comprising the step of coupling a tension control device to the mounting bracket to control an amount of mechanical movement of the seat relative to the pedestal base.

43. A method in accordance with claim 42 wherein said step of coupling a tension control device further comprises the step of coupling a coil spring to the mounting bracket to control an amount of mechanical movement of the seat relative to the pedestal base.

44. A method in accordance with claim 42 wherein said step of coupling a tension control device further comprises the step of coupling a helical tension spring to the mounting bracket to control an amount of mechanical movement of the seat relative to the pedestal base.

45. A method in accordance with claim 34 further comprising the step of coupling at least one stop to the mounting bracket to limit an amount of movement of the mounting bracket.

* * * * *